US011473357B2

(12) United States Patent
Bender

(10) Patent No.: US 11,473,357 B2
(45) Date of Patent: Oct. 18, 2022

(54) HINGE FOR A REMOVABLE VEHICLE DOOR

(71) Applicant: Frederick F Bender, South Lyon, MI (US)

(72) Inventor: Frederick F Bender, South Lyon, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 17/196,278

(22) Filed: Mar. 9, 2021

(65) Prior Publication Data

US 2022/0290477 A1 Sep. 15, 2022

(51) Int. Cl.
*E05D 7/10* (2006.01)
*E05D 5/12* (2006.01)
*E05D 3/02* (2006.01)

(52) U.S. Cl.
CPC ..... *E05D 5/12* (2013.01); *E05D 3/02* (2013.01); *E05Y 2900/531* (2013.01)

(58) Field of Classification Search
CPC .. E05D 5/10; E05D 5/12; E05D 5/128; E05D 3/02; E05D 7/10; E05Y 2900/531; Y10T 16/553; Y10T 16/5535; Y10T 16/5358; Y10T 16/53607; Y10T 16/536075
See application file for complete search history.

(56) References Cited

U.S. PATENT DOCUMENTS 1,189,201 A * 6/1916 Hurd ..... E05D 5/128 16/381
2,769,198 A * 11/1956 Foltz ..... E05D 11/04 16/381
2,808,611 A * 10/1957 Bauermeister ..... E05D 7/1044 16/258
3,013,297 A * 12/1961 Ferry ..... E05D 7/1022 16/263
3,135,013 A * 6/1964 Parsons ..... E05D 5/128 16/259
3,733,649 A * 5/1973 Nagy ..... E05D 11/0018 16/380
4,715,090 A * 12/1987 Morris ..... E05D 7/1044 16/261
5,040,268 A * 8/1991 Knurr ..... E05D 5/10 16/386
5,666,695 A * 9/1997 Jegers ..... E05D 7/1022 16/389
5,711,053 A * 1/1998 Hafner ..... E05D 5/128 16/380

(Continued)

FOREIGN PATENT DOCUMENTS

CN 207245453 U * 4/2018

*Primary Examiner* — Chuck Y Mah
(74) *Attorney, Agent, or Firm* — Ralph E. Smith

(57) ABSTRACT

In at least some implementations, a hinge for a vehicle door includes a door hinge adapted to be mounted to a vehicle door and a body hinge adapted to be mounted to a vehicle body. Either the door hinge or the body hinge includes a hinge pin, a void is defined by the other one of the door hinge or the body hinge that does not include the hinge pin, and a retainer is movable relative to the void. The hinge pin is received in the void in an assembled state of the hinge, and the retainer overlaps a retaining surface in an advanced position of the retainer to inhibit removal of the hinge pin from the void. In this way, the vehicle door may be releasably retained on the vehicle body.

18 Claims, 4 Drawing Sheets

(56) References Cited

U.S. PATENT DOCUMENTS

| | | | | |
|---|---|---|---|---|
| 5,722,121 | A * | 3/1998 | Lau | E05D 7/1022 16/389 |
| 7,325,276 | B2 | 2/2008 | Kim | |
| 7,805,811 | B2 * | 10/2010 | Shuker | E05D 5/128 16/382 |
| 10,415,282 | B2 * | 9/2019 | Klaffke | E05D 7/1022 |
| 10,738,520 | B2 | 8/2020 | Cherry et al. | |
| 2006/0174445 | A1 * | 8/2006 | Kim | E05D 5/128 16/360 |
| 2017/0268269 | A1 * | 9/2017 | Nicholas, III | E05D 7/1055 |
| 2019/0277074 | A1 | 9/2019 | Cherry et al. | |
| 2022/0042362 | A1 * | 2/2022 | Freedman | E05D 3/02 |

* cited by examiner

HINGE FOR A REMOVABLE VEHICLE DOOR

FIELD

The present disclosure relates to a hinge that facilitates removal and reinstallation of a vehicle door.

BACKGROUND

Some vehicles include doors that may be removed from and reinstalled on the vehicle, as desired by a user of the vehicle. The doors are connected to the vehicle by hinges that include a hinge pin or bolt with a threaded portion to which a nut is secured. Securing the nut/bolt requires a tool. The tool, nut and/or bolt can all be separated from the vehicle when a door is removed, and all need to be present wherever and whenever it is desired to reinstall the door.

SUMMARY

In at least some implementations, a hinge for a vehicle door includes a door hinge adapted to be mounted to a vehicle door and a body hinge adapted to be mounted to a vehicle body. Either the door hinge or the body hinge includes a hinge pin, a void is defined by the other one of the door hinge or the body hinge that does not include the hinge pin, and a retainer is movable relative to the void. The hinge pin is received in the void in an assembled state of the hinge, and the retainer overlaps a retaining surface in an advanced position of the retainer to inhibit removal of the hinge pin from the void. In this way, the vehicle door may be releasably retained on the vehicle body.

In at least some implementations, the retainer is carried by the other one of the door hinge or the body hinge, which includes the void. In at least some implementations, a connector is coupled to the other one of the door hinge or the body hinge, and the retainer is received between the connector and the other one of the door hinge or the body hinge. The connector may include a shank coupled to the other one of the door hinge or the body hinge and the retainer may include a slot through which the shank extends, with the retainer movable relative to the connector between the advanced position and a retracted position. In at least some implementations, the shank is threadedly coupled to the other one of the door hinge or the body hinge and the connector may be tightened against the retainer to maintain a position of the retainer. In at least some implementations, the shank is threadedly coupled to the other one of the door hinge or the body hinge and the connector includes a knob that is manually rotatable without a tool.

In at least some implementations, the other one of the door hinge or the body hinge includes an opening the leads to the void, and part of the retainer extends into the opening and into the void in the advanced position of the retainer. The hinge pin has an axis and is inserted into the void in the axial direction, and the hinge pin includes the retaining surface which is not parallel to the axis and which is overlapped or engaged by the retainer when the retainer is in the advanced position. The retainer may be movable relative to the void to a retracted position in which the retainer does not overlap or engage the retaining surface.

In at least some implementations, the other one of the door hinge or the body hinge includes an opening the leads to the void, and the retaining surface is defined by a surface that defines at least part of the opening.

In at least some implementations, the retainer is manually movable between the advanced position and a retracted position in which the retainer does not overlap the retaining surface. In at least some implementations, the hinge pin is fixed to one of the door hinge or the body hinge and is not removable from that one of the door hinge or the body hinge, and wherein the retainer is coupled to the other of the door hinge and body hinge.

In at least some implementations, the retaining surface is part of the door hinge. The retaining surface may be defined by a surface of the hinge pin or by a surface that defines an opening in the door hinge.

In at least some implementations, a hinge for a vehicle door includes a first hinge part adapted to be mounted to a vehicle door or to a vehicle body, a second hinge part adapted to be mounted to the other of the vehicle door or vehicle body, a retainer carried by the first hinge part and a connector coupled to the first hinge part. The retainer is received between part of the connector and the first hinge part, and the connector is movable relative to the first hinge part to releasably maintain a position of the retainer. Either the first hinge part or the second hinge part includes a hinge pin, a void is defined by the other one of the first hinge part or the second hinge part that does not include the hinge pin, and the retainer is movable relative to the void. The hinge pin is received in the void in an assembled state of the hinge, and the retainer overlaps a retaining surface in an advanced position of the retainer to inhibit removal of the hinge pin from the void, and the retaining surface is part of either the first hinge part of the second hinge part that the retainer is not carried by.

In at least some implementations, an opening is provided that leads to the void, and the retaining surface is defined by either a surface that defines the opening or by a surface of the hinge pin. In at least some implementations, the connector includes a shank coupled to the first hinge part and the retainer includes a slot through which the shank extends, with the retainer movable relative to the connector between the advanced position and a retracted position. In at least some implementations, the shank is threadedly coupled to the first hinge part and the connector includes a knob that is manually rotatable without a tool, and wherein the retainer is manually movable between the advanced position and a retracted position in which the retainer does not overlap the retaining surface.

Further areas of applicability of the present disclosure will become apparent from the detailed description, claims and drawings provided hereinafter. It should be understood that the summary and detailed description, including the disclosed embodiments and drawings, are merely exemplary in nature intended for purposes of illustration only and are not intended to limit the scope of the invention, its application or use. Thus, variations that do not depart from the gist of the disclosure are intended to be within the scope of the invention.

DETAILED DESCRIPTION

Figure 1:
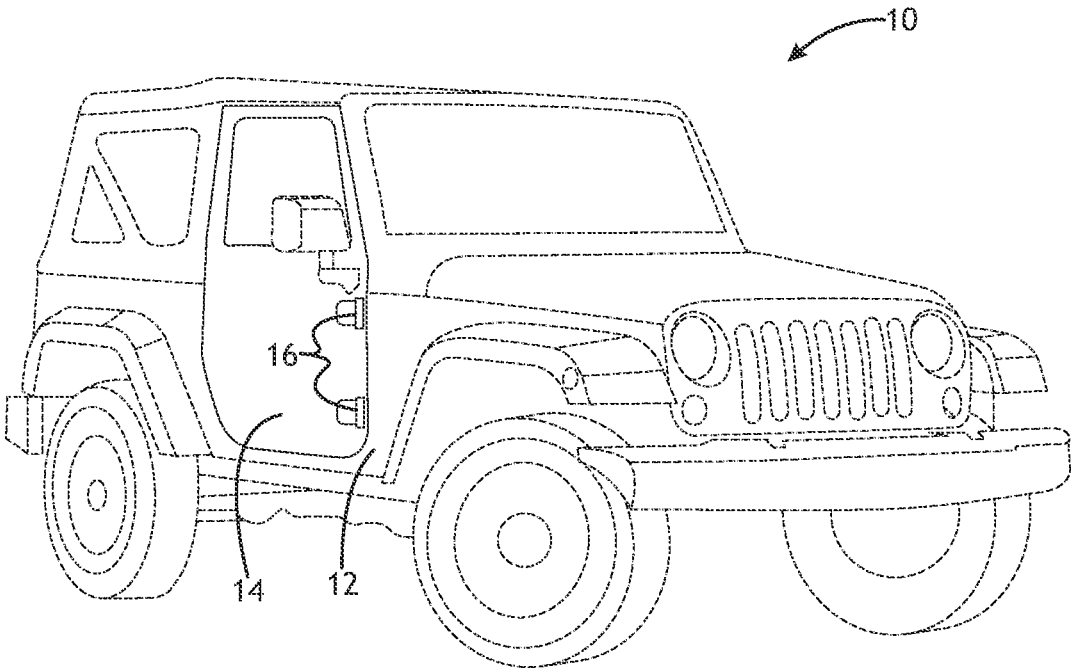
FIG. 1 is a perspective view of a vehicle having a door removably connected to a vehicle body by hinges.
Figure 2:
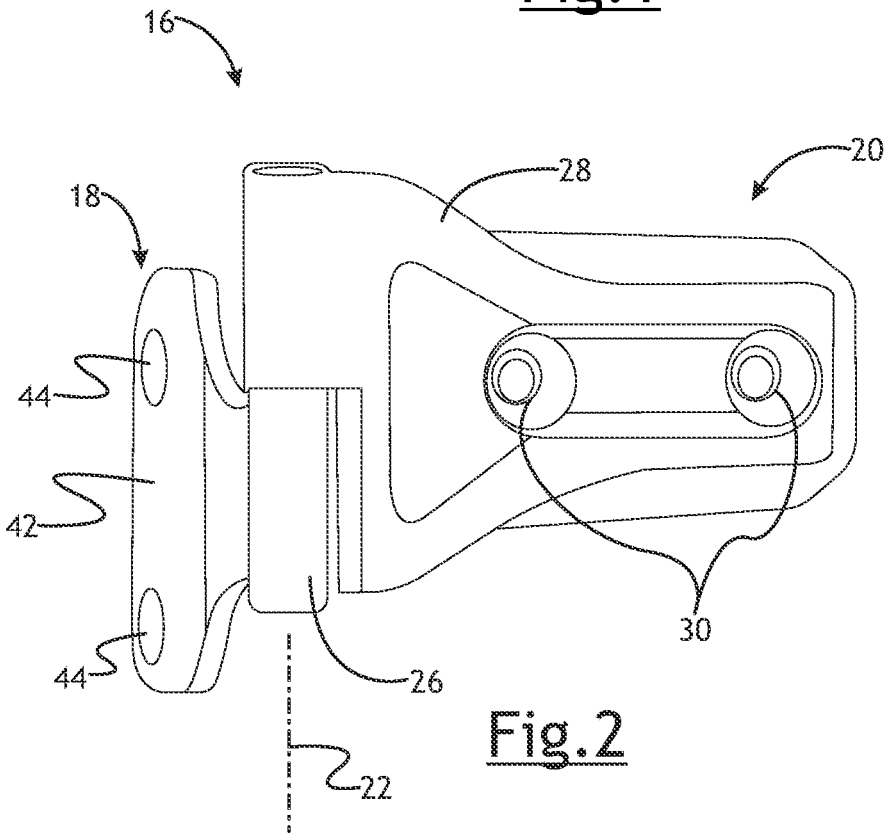
FIG. 2 is a perspective, front view of one of the hinges in an assembled state with the hinge including a door part connected to a body part.
Figure 3:
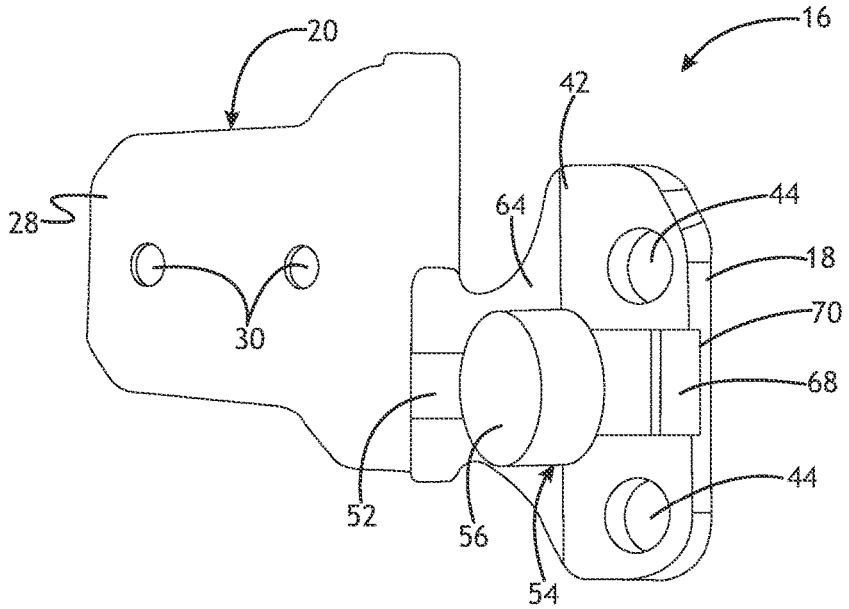
FIG. 3 is a perspective, rear view of the hinge in an assembled state.

Referring in more detail to the drawings, FIG. 1 illustrates a vehicle 10 having a body 12 and a door 14 coupled to the body 12 by one or more hinges 16, with two hinges shown in this example vehicle. As shown in FIGS. 2-5, each hinge 16 includes a first hinge part that is connected to either the vehicle body or the door and is releasably coupled to a second hinge part that itself is connected to the other one of the vehicle body or door. In the example illustrated in FIGS. 1-7, the first hinge part is coupled to the vehicle body 12 and is referred to as a body part 18, and the second hinge part is coupled to the door 14 and is referred to as a door part 20. In assembly, the door part 20 is coupled to the body part 18 to install the door 14 on the vehicle body 12. The door 14 may swing or pivot about an axis 22 and relative to the vehicle body 12 between open and closed positions. The door part 20 of the hinge 16 may be disconnected from the body part 18 to permit the vehicle door 14 to be removed from the vehicle body 12, and the door part 20 may be reconnected to the body part 18 to reconnect the door to the vehicle body 12.

Figure 4:
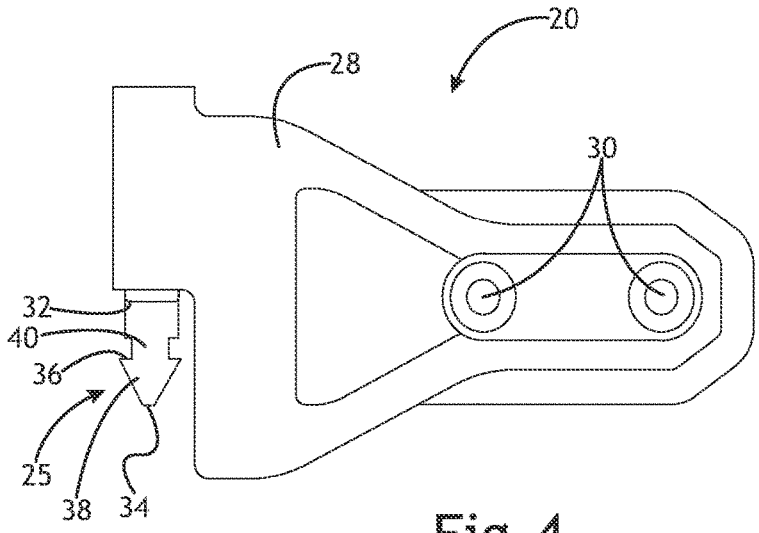
FIG. 4 is a front view of the door part.
Figure 7:
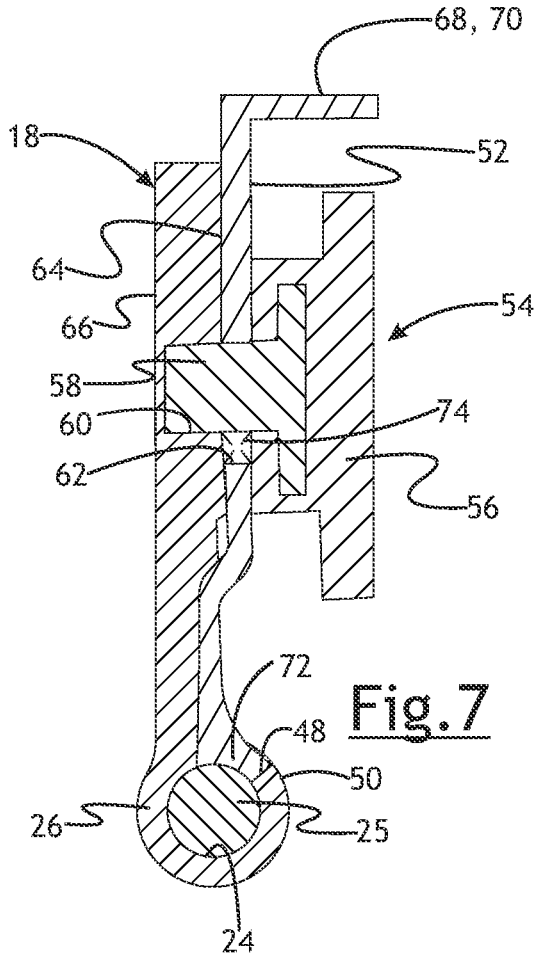
FIG. 7 is a sectional view taken generally along line 7-7 in FIG. 6.

One of the body and door parts 18, 20 defines at least part of a void 24 (FIGS. 5 and 7) and the other of the body and door parts 18, 20 includes a hinge pin 25 (FIGS. 4 and 7). When the body and door parts 18, 20 are coupled together, the hinge pin 25 coaxially extends into the void 24. When the door 14 is pivoted relative to the vehicle body 12 between the open and closed positions of the door, there is relative rotation between the hinge pin 25 and the hinge part 18 or 20 that defines the void 24. In the example shown in FIGS. 1-7, the body part 18 includes a tubular barrel 26 that defines the void 24 and the door part 20 includes the hinge pin 25.

As shown in at least FIG. 4, the door part 20 includes a main body 28 having one or more openings 30 through which fasteners are received to couple the door part 20 to the vehicle door 14. In the example shown, the hinge pin 25 is fixed to the door part 20. The hinge pin 25 could be formed separately from the remainder of the door part 20 (e.g. the main body 28), or they could be formed from a single piece of material, as desired. While described as being fixed to the door part 20 and not movable relative to the door part 20, the hinge pin 25 could rotate about the axis and/or move axially relative to the door part 20, if desired. In the example shown, the hinge pin 25 is coupled to the main body 28 of the door part 20 at a base 32 and extends axially to a free end 34. To enable receipt of the pin 25 within the barrel 26 of the body part 18, the free end 34 and at least part of the exterior of the base 32 is spaced from the main body 28 This provides room for part of the barrel 26 to be received between the hinge pin 25 and the main body 28 when the hinge parts 18, 20 are coupled and the hinge pin 25 is received in the void 24.

In at least some implementations, the hinge pin 25 includes at least one retention surface 36 that is not parallel to the axis 22 of the hinge pin 25. In at least some implementations, the retention surface 36 is located between the base 32 and free end 34 of the pin 25 and is oriented perpendicular to the axis or within forty-five (45) degrees of perpendicular. The hinge pin 25 may have any desired perimeter shape and is shown as having a cylindrical base 32, a tapered or conical head 38 at the free end 34 to facilitate alignment of the pin 25 with the void 24, and a neck 40 between the base 32 and head 38. In at least some implementations, the base 32 has a periphery sized for close receipt in the void 24 within the barrel 26 of the body part 18, to securely hold the vehicle door 14 relative to the vehicle body 12 with limited play, rocking or undesired movement, and the retention surface 36 extends inwardly toward the axis 22 compared to the periphery of the base 32. In the example shown, the base 32 has a greater cross-sectional area than the neck 40, and the portion of the head 38 adjacent to the neck 40 also has a greater cross-sectional area than the neck 40. This provides axially spaced apart and radially inwardly extending surfaces at the ends of the neck 40, and at least one retention surface 36 is defined by the inwardly extending surface between the neck 40 and head 38. In the example shown, the retention surface 36 is annular, and extends circumferentially around the neck 40 which is cylindrical. The neck 40 may be otherwise shaped, and the retention surface 36 need not be annular.

Figure 5:
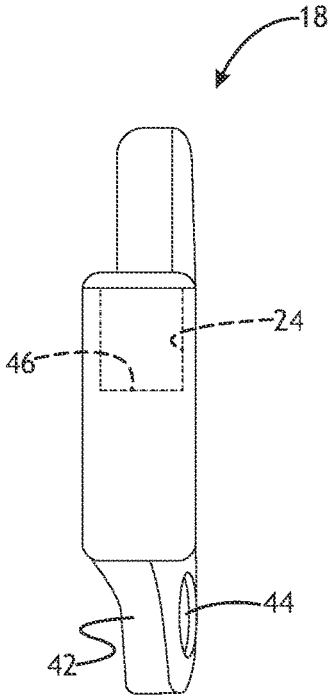
FIG. 5 is a side view of the body part.
Figure 6:
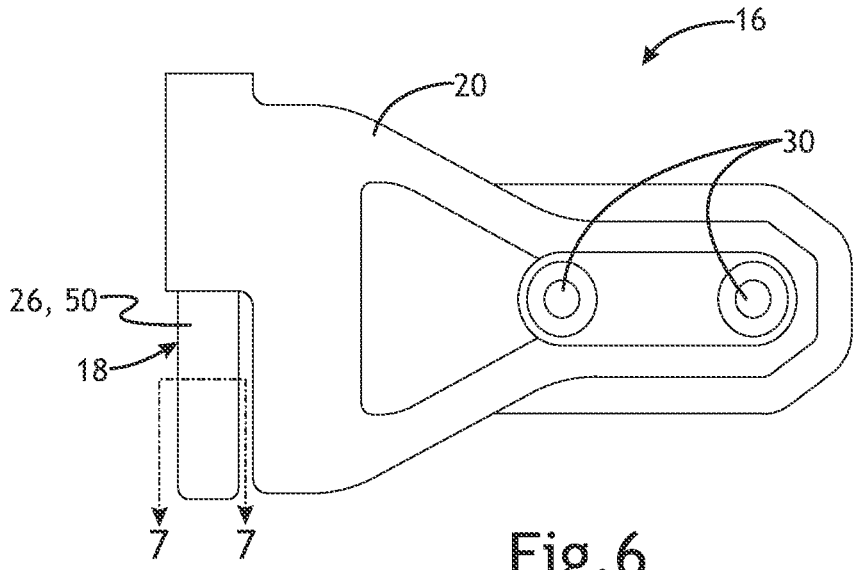
FIG. 6 is a front view of the hinge in the assembled state.

As shown in at least FIG. 5, the body part 18 has a main body 42 with one or more openings 44 through which fasteners are received to couple the body part 18 to the vehicle body 12. In the example shown, the barrel 26 is formed in the same piece of material as the main body 42, and the void 24 is cylindrical and has a diameter for receipt of the hinge pin 25. In at least some implementations, the void 24 is a blind bore, that is, the void 24 does not extend through the barrel 26 and instead the void 24 is open through one end of the barrel 26 and terminates within the barrel 26 at a bottom surface 46 (FIG. 5). Thus, in the assembled state of the hinge 16, the hinge pin 25 does not extend through the barrel 26 and the hinge pin 25 has an axial length that is equal to or less than the axial depth of the void 24. The body part 18 includes an opening 48 (FIG. 7) provided in the barrel 26 and which is open to the void 24 and through an exterior surface 50 of the barrel 26. The opening 48 is arranged to receive a retainer 52 (FIGS. 3 and 7) that is movable relative to the void 24 and opening 48 to selectively retain the hinge parts 18, 20 in an assembled state and permit the hinge parts 18, 20 to be separated so that the vehicle door 14 can be removed from the vehicle body 12 when desired.

In at least some implementations, the retainer 52 is coupled to and supported or carried by the body part 18. To maintain the retainer 52 on the body part 18, a connector 54 is provided that traps a portion of the retainer 52 between the connector 54 and the body part 18. In the example shown in FIG. 7, the connector 54 includes a head or knob 56 at one end of a threaded shank 58 that is received within a threaded opening 60 in the main body 42 of the body part 18. The shank 58 extends through a slot 62 formed in the retainer 52, between the ends of the retainer 52, and the retainer 52 is positioned between the knob 56 and main body 42. The retainer 52 is movable relative to the connector 54 and the body part 18, between an advanced position in which a portion of the retainer 52 is received in the void 24, and a retracted position in which the portion of the retainer 52 is removed from the void 24 or less of the retainer 52 is in the void 24 compared to the retracted position. In the example shown, the retainer 52 is slidable relative to the void 24, although the retainer 52 may be moved in any desired way including pivoting, or rotating and advanced along an axis of rotation (e.g. by threads or otherwise) or sliding or some combination of these or by other direction or manner of movement. The main body 42 of the body part 18 has a generally flat, planar surface 64 that is opposite to the surface 66 received against the vehicle body 12, and the retainer 52 may be parallel to that surface 64 and slidable along that surface 64, in at least some implementations. The retainer 52 is thus accessible by a user when the vehicle door 14 is open and the inward facing surface 64 of the body part 18 is exposed. The retainer 52 could be biased by a spring to the advanced position, and movable to the retracted position against the spring force, if desired.

The retainer 52 may include a handle 68 that may be manipulated by a user to facilitate moving the retainer 52 relative to the body part 18 and void 24. In the example shown, the handle 68 is defined by a bent portion of the retainer 52 body, at an end of the retainer 52 (e.g. a first end 70) spaced from the portion of the retainer 52 that projects into the void 24 (e.g. a second end 72). The connector 54 may be received between the handle 68 at the first end 70 and the portion of the retainer 52 that projects into the void 24, which may be an opposite, second end 72 in at least some implementations. The retainer 52 may be pushed and pulled to move the retainer 52 between the advanced and retracted positions.

To connect the vehicle door 14 to the vehicle body 12, the door part 20 is coupled to the body part 18. To enable the hinge pin 25 to be received in the void 24 of the barrel 26, the retainer 52 is positioned in the retracted position. In this position, the retainer 52 is moved fully or sufficiently out of the void 24 and the hinge pin 25 can be inserted into the void 24 in a first direction along the axis 22 of the hinge pin 25 and void 24. When fully inserted into the void 24, the retaining surface 36 of the hinge pin 25 is axially aligned with the opening 48 in the barrel 26 of the body part 18. In this position, when the retainer 52 is moved to the advanced position, a portion of the retainer 52 within the void 24 overlaps and may engage the retaining surface 36 of the hinge pin 25. This overlap inhibits or prevents movement of the hinge pin 25 in a second direction along the axis 22, opposite to the first direction, and thus inhibits or prevents removal of the hinge pin 25 from the barrel 26, to maintain the door part 20 coupled to the body part 18. The retainer 52 moves in a direction that is not parallel to the axis 22, and in the illustrated example, the retainer 52 moves perpendicular to the axis 22. To hold the retainer 52 in the advanced position when the door part 20 is coupled to the body part 18, the connector 54 can be rotated to tighten the connector 54 against the retainer 52 and to firmly trap the retainer 52 against the body part 18.

The retainer 52 can be manually moved between the advanced and retracted positions, and/or the retainer 52 can be automatically moved by a spring 74 (diagrammatically shown in FIG. 7 as being received in the retainer slot 62 and engaging the shank 58). In the latter example, the tapered/inclined head 38 of the hinge pin 25 may engage and displace the retainer 52 outwardly as the hinge pin 25 is inserted into the void 24, until the head 38 passes the retainer 52 and then the spring 74 advances the retainer 52 toward the neck 40 and axis, wherein the retainer 52 overlaps the retaining surface.

To remove the door from the vehicle body, the door part 20 is decoupled from the body part 18 by retracting the retainer 52 sufficiently so that it is clear of the retaining surface 36 and the hinge pin 25 can move in the second direction, out of the barrel 26. If the connector 54 was tightened to maintain the coupled state of the hinge 16, the connector 54 is rotated to loosen the connector 54 and permit retraction of the retainer 52. At all times, in at least some implementations, the connector 54 can remain coupled to the body part 18 (or other component to which it is connected) and the retainer 52 can remain coupled to the body part 18 by the connector 54. If desired, the connector 54 can be removable from the body part 18 (or whatever component the retainer 52 is carried by) to, for example, permit cleaning or repair of the mechanism.

Accordingly, the hinge includes a retainer 52 that facilitates removal of a vehicle door 14 without requiring a tool (the retainer can be moved by hand, and the connector can be tightened by hand), can maintain a coupled state of the hinge (the retainer overlaps the retaining surface), and permits reinstallation of the vehicle door 14 on the vehicle body 12 without requiring a tool or any component that must be separated from the vehicle body or door, such as may be necessary to remove a hinge bolt or nut in a conventional hinge. Further, the retainer 52 can be carried by the hinge 16, or another portion of the vehicle, and remain carried by whatever component without having to be removed from the component. Thus, the retainer 52 described herein, in at least some implementations, remains connected to the vehicle (e.g. body or door or hinge part) and need not be removed from the vehicle to remove a vehicle door 14.

If a vehicle door with a conventional hinge is removed from a vehicle at a first location, a hinge bolt or nut may be left at that location and thus not available if it is desired to reinstall the door on the vehicle at a second location. Similarly, a tool or tools needed to remove the door (e.g. the hinge pin 25 and/or nut) may be left at the first location and not available at the second location to reinstall the door. If the tool(s), hinge pin/bolt or nut are lost, they must be replaced before the door can be reinstalled. These problems can be avoided with the retainer 52 described herein which can be moved between its advanced and retracted positions without any tool, and which can remain connected to the vehicle regardless of whether the vehicle door 14 is connected to the vehicle body 12. Further, upon visual inspection it can readily be seen if the retainer is in the advanced or retracted position, and visual indicia can be provided on the hinge or elsewhere to facilitate visual determination of the retainer position. Any electrical connections that need to be connected/disconnected as the door is installed or removed from the vehicle 10 can be in the area of a hinge 16, within an inboard side of the door at which the retainer is accessed. So all connections and disconnections can conveniently be made in the same area of the door. Further, the retention of the door hinge occurs within the hinge, and not by an exteriorly visible bolt or nut, improving the appearance and simplicity of the hinge 16. Further, the locking knob 56 is round and inertia neutral compared to a lever or other non-round lock member. The retainer may easily slide to the advanced position without requiring a cam mechanism which would require some force to lock the hinge parts in place. By overlapping in the direction that the door part is removed from the body part, the door can securely be held on the vehicle without a cam lock.

Figure 8:
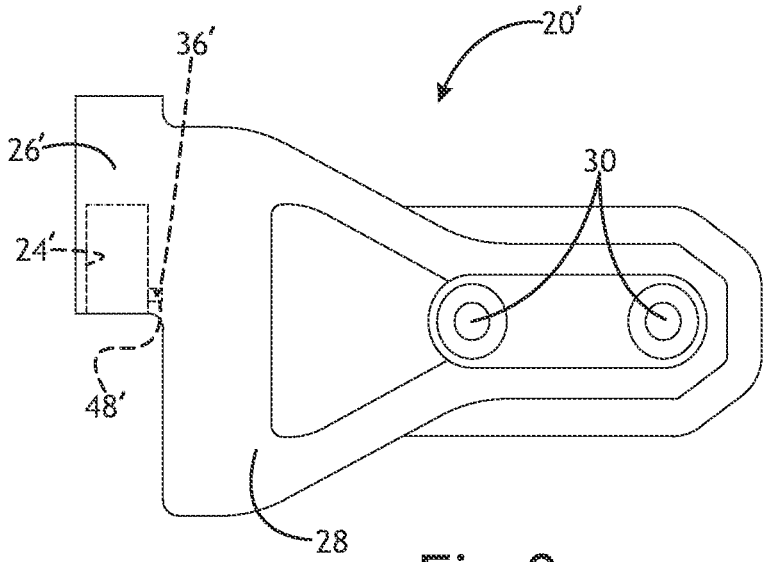
FIG. 8 is a front view of an alternate door part.
Figure 9:
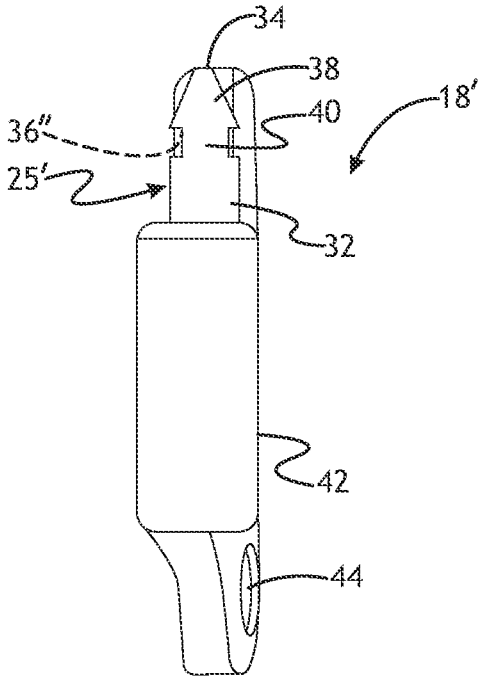
FIG. 9 is a side view of an alternate body part.

While the example illustrated in FIGS. 2-7 shows the door part 20 as including the hinge pin 25, the door part 20' could instead include the barrel 26', void 24' and opening 48', as shown in FIG. 8. The hinge pin 25', as shown in FIG. 9, could be part of the body part 18'. In such an arrangement, when the vehicle door 14 is installed on the vehicle, the barrel 26' would be received over the hinge pin 25', and the retainer 52 could be moved relative to the opening 48'. The retainer 52 may simply overlap the opening 48', a surface of which may be called a retaining surface 36', to inhibit or prevent removal of the door part 20' from the body part 18'. In such an implementation, the hinge pin 25' could be cylindrical or otherwise formed without a retaining surface. In at least some implementations, the retainer 52 may also extend into the void 24' and overlap a retaining surface 36" of the hinge pin 25. If the retainer 52 were carried by the door part 20', then, in this example, the retainer 52 would overlap a retaining surface of the hinge pin 25', or other retaining surface of the body part 18 to maintain the assembled state of the hinge.

In at least some implementations, the retainer 52 is carried by (e.g. connected to and supported by) one of the first hinge part and the second hinge part. That is, by either the door part 20 and the body part 18. The retaining surface is defined by a portion of the hinge part that does not include or carry the retainer 52. In this way, when the retainer 52 is in the advanced position, movement of the retaining surface relative to the retainer 52 is inhibited or prevented. Thus, the hinge part defining the retaining surface is inhibited or prevented from moving relative to the hinge part that includes/carries the retainer 52. And the assembled state of the hinge 16 can be maintained and unintentional separation of the hinge parts can be prevented, while intentional separation is permitted when the retainer 52 is moved to the retracted position.

What is claimed is:

1. A hinge for a vehicle door, comprising:

a door hinge adapted to be mounted to a vehicle door;

a body hinge adapted to be mounted to a vehicle body, wherein either the door hinge or the body hinge includes a hinge pin, a void is defined by the other one of the door hinge or the body hinge that does not include the hinge pin, and a retainer is movable relative to the void, and wherein the hinge pin is received in the void in an assembled state of the hinge, and the retainer overlaps a retaining surface in an advanced position of the retainer to inhibit removal of the hinge pin from the void, wherein a connector is coupled to said other one of the door hinge or the body hinge, the connector is movable relative to the retainer to releasably trap a portion of the retainer against said other one of the door hinge or the body hinge to prevent movement of the retainer and maintain the advanced position of the retainer.

2. The hinge of claim 1 wherein the retainer is carried by said other one of the door hinge or the body hinge.

3. The hinge of claim 1 wherein the retainer is received between a portion of the connector and said other one of the door hinge or the body hinge.

4. The hinge of claim 3 wherein the connector includes a shank coupled to said other one of the door hinge or the body hinge and the retainer includes a slot through which the shank extends, with the retainer movable relative to the connector between the advanced position and a retracted position.

5. The hinge of claim 4 wherein the connector includes a knob by which the connector is rotatable relative to the retainer to move the knob toward and away from the retainer, and wherein in one position of the connector the knob engages and traps the retainer against said other one of the door hinge or the body hinge.

6. The hinge of claim 3 wherein the shank is threadedly coupled to said other one of the door hinge or the body hinge and the connector includes a knob that is manually rotatable without a tool.

7. The hinge of claim 1 wherein said other one of the door hinge or the body hinge includes an opening that leads to the void, and wherein part of the retainer extends into the opening and into the void in the advanced position of the retainer.

8. The hinge of claim 7 wherein the hinge pin has an axis and is inserted into the void in the axial direction, and the hinge pin includes the retaining surface that is not parallel to the axis and which is overlapped or engaged by the retainer when the retainer is in the advanced position.

9. The hinge of claim 8 wherein the retainer is movable relative to the void to a retracted position in which the retainer does not overlap or engage the retaining surface.

10. The hinge of claim 1 wherein the retainer is manually movable between the advanced position and a retracted position in which the retainer does not overlap the retaining surface.

11. The hinge of claim 1 wherein the hinge pin is fixed to one of the door hinge or the body hinge and is not removable from said one of the door hinge or the body hinge, and wherein the retainer is coupled to the other of the door hinge and body hinge.

12. The hinge of claim 1 wherein the retaining surface is part of the door hinge separate from the hinge pin.

13. The hinge of claim 12 wherein the retaining surface is defined by a surface that defines an opening in the door hinge.

14. A hinge for a vehicle door, comprising:

a door hinge adapted to be mounted to a vehicle door;

a body hinge adapted to be mounted to a vehicle body, wherein either the door hinge or the body hinge includes a hinge pin, a void is defined by the other one of the door hinge or the body hinge that does not include the hinge pin, and a retainer is movable relative to the void, and wherein the hinge pin is received in the void in an assembled state of the hinge, and the retainer overlaps a retaining surface in an advanced position of the retainer to inhibit removal of the hinge pin from the void, wherein said other one of the door hinge or the body hinge includes an opening the leads to the void, and the retaining surface is defined by a surface or said other one of the door hinge or the body hinge that defines at least part of the opening.

15. A hinge for a vehicle door, comprising:

a first hinge part adapted to be mounted to a vehicle door or to a vehicle body;

a second hinge part adapted to be mounted to the other of the vehicle door or vehicle body;

a retainer carried by the first hinge part;

a connector coupled to the first hinge part, with the retainer received between part of the connector and the first hinge part, the connector being movable relative to the first hinge part to releasably trap a portion of the retainer between the connector and the first hinge part to releasably maintain a position of the retainer, wherein either the first hinge part or the second hinge part includes a hinge pin, a void is defined by the other one of the first hinge part or the second hinge part that does not include the hinge pin, and the retainer is movable relative to the void, and wherein the hinge pin is received in the void in an assembled state of the hinge, and the retainer overlaps a retaining surface in an advanced position of the retainer to inhibit removal of the hinge pin from the void, and the retaining surface is part of either the first hinge part or the second hinge part that the retainer is not carried by.

16. The hinge of claim 15 which also includes an opening that leads to the void, and wherein the retaining surface is defined by either a surface that defines the opening or by a surface of the hinge pin.

17. The hinge of claim 15 wherein the connector includes a shank coupled to the first hinge part and the retainer includes a slot through which the shank extends, with the retainer movable relative to the connector between the advanced position and a retracted position.

18. The hinge of claim 17 wherein the shank is threadedly coupled to the first hinge part and the connector includes a knob that is manually rotatable without a tool, and wherein the retainer is manually movable between the advanced position and a retracted position in which the retainer does not overlap the retaining surface.

* * * * *